US010215438B2

(12) United States Patent
Dempsey

(10) Patent No.: US 10,215,438 B2
(45) Date of Patent: Feb. 26, 2019

(54) SYSTEM AND METHOD OF DETERMINING A LIMIT FAULT IN AN HVAC UNIT

(71) Applicant: Carrier Corporation, Farmington, CT (US)

(72) Inventor: Daniel J. Dempsey, Carmel, IN (US)

(73) Assignee: CARRIER CORPORATION, Farmington, CT (US)

( * ) Notice: Subject to any disclaimer, the term of this patent is extended or adjusted under 35 U.S.C. 154(b) by 43 days.

(21) Appl. No.: 15/256,365

(22) Filed: Sep. 2, 2016

(65) Prior Publication Data

US 2017/0067660 A1 Mar. 9, 2017

Related U.S. Application Data

(60) Provisional application No. 62/214,006, filed on Sep. 3, 2015.

(51) Int. Cl.

| | |
|---|---|
| ***F24F 11/00*** | (2018.01) |
| ***F24F 11/62*** | (2018.01) |
| ***F24F 11/30*** | (2018.01) |
| *F24F 110/00* | (2018.01) |
| *F24F 11/32* | (2018.01) |
| *F24F 11/64* | (2018.01) |
| *F24F 11/61* | (2018.01) |

(52) U.S. Cl.

CPC ..... *F24F 11/62* (2018.01); *F24F 11/30* (2018.01); *F24F 11/32* (2018.01); *F24F 11/61* (2018.01); *F24F 11/64* (2018.01); *F24F 2110/00* (2018.01)

(58) Field of Classification Search

CPC ..... H02J 3/50
USPC ..... 700/278
See application file for complete search history.

(56) References Cited

U.S. PATENT DOCUMENTS

| | | | | |
|---|---|---|---|---|
| 4,872,828 | A | 10/1989 | Mierzwinski et al. | |
| 4,887,767 | A | 12/1989 | Thompson et al. | |
| 5,197,664 | A | 3/1993 | Lynch | |
| 5,377,909 | A | 1/1995 | Kirkpatrick | |
| 5,444,436 | A | 8/1995 | Kennison | |
| 5,984,003 | A | 11/1999 | Butler | |
| 6,244,515 | B1 | 6/2001 | Rowlette et al. | |
| 6,748,163 | B2 | 6/2004 | Wilson | |
| 2004/0180305 | A1 | 9/2004 | Dempsey et al. | |
| 2004/0230402 | A1 | 11/2004 | St. Jean | |
| 2006/0131434 | A1 | 6/2006 | Butler et al. | |
| 2012/0125559 | A1 | 5/2012 | Fadell et al. | |
| 2013/0126315 | A1 | 5/2013 | Tobita et al. | |
| 2013/0158723 | A1* | 6/2013 | Erickson | F24F 11/30 700/278 |

(Continued)

*Primary Examiner* — Emilio J Saavedra
(74) *Attorney, Agent, or Firm* — Cantor Colburn LLP

(57) ABSTRACT

A system and method of determining a limit fault in an HVAC unit the HVAC unit in electrical communication with an HVAC system controller, by operating the system controller to determine whether an interruption duration of time exceeds an interruption limit, operating the system controller to determine whether a cycle duration of time is less than or equal to a first cycle limit, wherein the cycle duration of time is indicative of an amount of time between consecutive interruptions of power, and generating an alert signal if the interruption duration of time of the consecutive interruptions of power exceeds the interruption limit and the cycle duration of time is less than or equal to the first cycle limit.

9 Claims, 4 Drawing Sheets

(56) References Cited

U.S. PATENT DOCUMENTS

| | | | | |
|---|---|---|---|---|
| 2014/0034284 | A1 | 2/2014 | Butler et al. | |
| 2015/0159887 | A1* | 6/2015 | Kadah | F24D 19/1084 700/276 |
| 2015/0338133 | A1* | 11/2015 | Havard, Jr. | F25B 7/00 62/175 |
| 2017/0051925 | A1* | 2/2017 | Stefanski | F24F 11/30 |

* cited by examiner

SYSTEM AND METHOD OF DETERMINING A LIMIT FAULT IN AN HVAC UNIT

CROSS-REFERENCE TO RELATED APPLICATIONS

The present application is a nonprovisional patent application, which claims priority to U.S. Provisional Patent Application Ser. No. 62/214,006, filed Sep. 3, 2015, and having the title "SYSTEM AND METHOD FOR DETERMINING A LIMIT FAULT IN AN HVAC UNIT," which is herein incorporated in its entirety.

TECHNICAL FIELD OF THE DISCLOSED EMBODIMENTS

The presently disclosed embodiments generally relate to appliances for heating and cooling air, and more particularly, to a system and method for determining a limit fault in an HVAC unit.

BACKGROUND OF THE DISCLOSED EMBODIMENTS

Typically, modern furnaces and boilers include a temperature sensor; often called a limit switch, to detect when components of the HVAC system are operating above a threshold temperature. Operation above the threshold temperature could pose a hazard to both the HVAC system and the space that the HVAC system is located within. Generally, when a limit switch opens during an over-heat condition, the control board within the HVAC unit shuts off the fuel supply and power to the furnace, and operates the blower to cool off the air passageway. Also, the system controller (e.g. thermostat), may go blank due to the loss of power. This may continue several times, during which point HVAC unit may operate LEDs on the appliance control board to signal a fault condition, without any indication to the system controller, which is most visible to the user.

Accordingly, there exists a need for an improved system and method to determine a limit fault in an HVAC unit.

SUMMARY OF THE DISCLOSED EMBODIMENTS

In one aspect, and HVAC system is provided. The HVAC system includes an HVAC unit configured to interrupt power when a temperature sensed by a temperature sensitive limit switch exceeds a predetermined temperature, and a system controller in electrical communication with the HVAC unit, the system controller is configured to determine a temperature limit switch fault based upon an interruption duration of time and a cycle duration of time, wherein the cycle duration of time is indicative of an amount of time between consecutive interruptions of power. In one embodiment, the system controller is in wireless electrical communication with the HVAC unit. In an embodiment, the system controller includes a thermostat.

In an embodiment, the system controller is further configured to generate an alert signal if it is determined that the interruption duration of time of consecutive interruptions of power does not exceed the interruption limit and the cycle duration of time is less than or equal to a first cycle limit. In another embodiment, the system controller is further configured to generate the alert signal if it is determined that the interruption duration of time exceeds the interruption limit and the cycle duration of time is less than or equal to a second cycle limit. In one embodiment, the alert signal includes at least one of a visual signal, an audio signal, and an electronic signal.

In one aspect, and HVAC system controller is provided. The HVAC system controller includes a processor, and a memory, wherein the processor is configured to operate a program stored in memory, the program configured to determine whether an interruption duration of time exceeds an interruption limit, determine whether a cycle duration of time is less than or equal to a first cycle limit, wherein the cycle duration of time is indicative of an amount of time between consecutive interruptions of power, generate an alert signal if the interruption duration of time of the consecutive interruptions of power exceeds the interruption limit and the cycle duration of time is less than or equal to the first cycle limit. In one embodiment, the interruption limit is approximately 3 minutes. In an embodiment, the first cycle limit is approximately 30 minutes.

In one embodiment, the program is further configured to determine that a blower of the HVAC system is malfunctioning if the cycle duration of time is less than or equal to a second cycle limit if the interruption duration of time exceeds the interruption limit. In an embodiment, the program is further configured to generate the alert signal if the blower of the HVAC system is malfunctioning.

In an embodiment, the second cycle limit is approximately 5 hours. In one embodiment, the alert signal includes at least one of a visual signal, an audio signal, and an electronic signal.

In one aspect, a method of determining a cause for a limit fault in an HVAC unit including a limit switch, the HVAC unit in electrical communication with an HVAC system controller is provided. The method includes operating the HVAC unit to interrupt power to the HVAC system controller when the limit switch is in a fault condition, operating the system controller to determine whether an interruption duration of time exceeds an interruption limit, operating the system controller to determine whether a cycle duration of time is less than or equal to a first cycle limit if the interruption duration of time does not exceed the interruption limit, wherein the cycle duration of time is indicative of an amount of time between consecutive interruptions of power, and operating the system controller to generate an alert signal if the cycle duration of time is less than or equal to the first cycle limit.

In an embodiment, the method further includes operating the system controller to determine whether the cycle duration of time is less than or equal to a second cycle limit if the interruption duration of time between consecutive interruptions of power exceeds the interruption limit. In one embodiment, the method further includes generating the alert signal if the cycle duration of time is less than or equal to the second cycle limit and the interruption duration of time between consecutive interruptions of power exceeds the interruption limit. In one embodiment, the alert signal comprises at least one of a visual signal, an audio signal, and an electronic signal.

In one embodiment, the interruption limit is approximately 3 minutes. In one embodiment, the first cycle limit is approximately 30 minutes. In one embodiment, the second cycle limit is approximately 5 hours.

DETAILED DESCRIPTION OF THE DISCLOSED EMBODIMENTS

Figure 1:
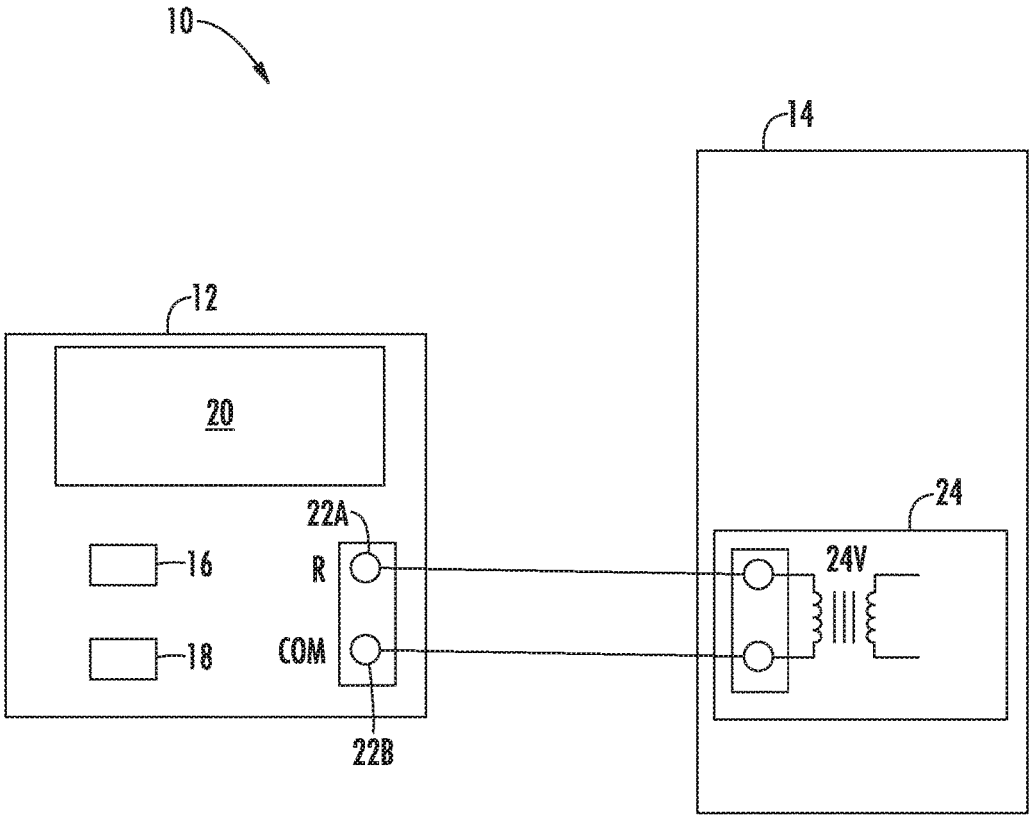
FIG. 1 illustrates a schematic diagram of a HVAC system according to an embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 schematically illustrates an embodiment of an HVAC system, generally indicated at 10, configured to condition air within an interior space. The HVAC system 10 includes a system controller 12 operably coupled to an HVAC unit 14. The HVAC unit 14 is configured to operate in a heating mode. In an embodiment, the system controller 12 is in wireless electrical communication with the HVAC unit 14. In another embodiment, the system controller 12 is in wired electrical communication with the HVAC unit 14. It will be appreciated that the HVAC unit 14 may be a gas-fired furnace, oil-fired furnace, gas-fired boiler, oil-fired boiler, and a packaged unit to name a few non-limiting examples.

The system controller 12 includes a processor 16 in communication with a memory 18. In some embodiments, the system controller 12 includes a display 20 in communication with the processor 16. The display 20 is configured to provide relevant information regarding the operation and status of the HVAC system 10.

In some embodiments, the system controller 12 further includes a plurality of terminals 22 used to wire the system controller 12 to the HVAC unit 14. As shown in the embodiment, the COM terminal 22A and R-terminal 22B are operably coupled to corresponding 24-volt terminals on a control board 24 within the HVAC unit 14. In an embodiment, the system controller 12 is a thermostat. In another embodiment the system controller 12 may be any type of HVAC control device having a processor 16 including a mobile phone application.

Figure 2:
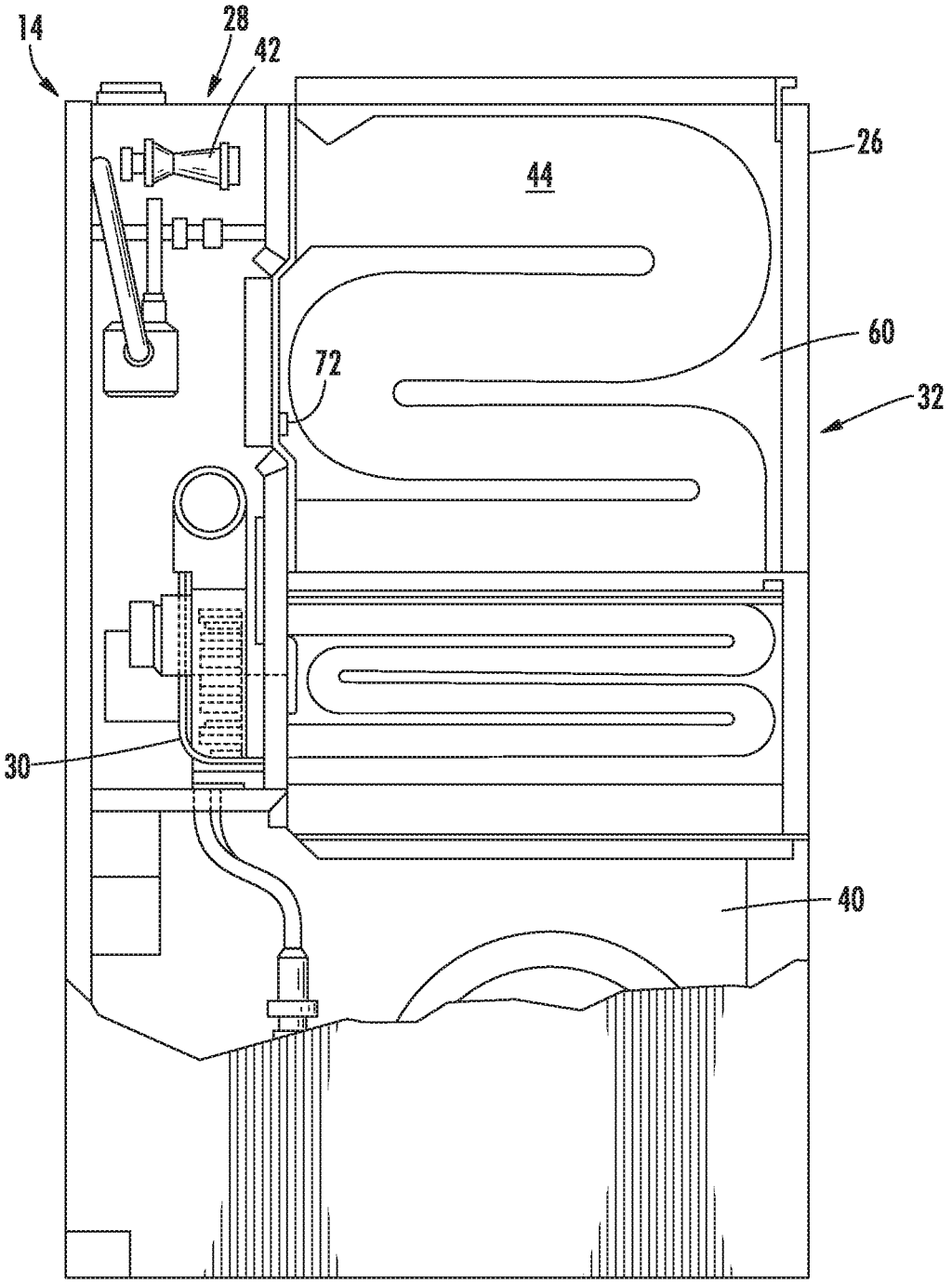
FIG. 2 illustrates a schematic diagram of an HVAC unit according to an embodiment of the present disclosure.

Referring to FIG. 2, there is illustrated a gas-fired furnace which may be operated according to the principles of the present invention. The following description is made with reference to a condensing furnace 14, but it should be understood that the present invention also contemplates incorporation into a noncondensing-type furnace, or any other type of heat supplying HVAC unit 14.

A condensing furnace 14 typically includes, amongst other things, a cabinet 26, housing therein a burner assembly box 28, combination gas control 30, heat exchanger assembly 32, and circulating air blower 40. The burner assembly 28 typically further includes at least one burner 42 for at least one primary heat exchanger 44. Burner 42 receives a flow of combustible gas from combination gas control 30. The resulting combustion gases then enters the heat exchanger 44, part of the heat exchanger assembly 32, where a portion of its heat is given up to the air flowing over the heat exchanger 44.

In an embodiment, the air blower 40 delivers air to be heated upwardly through an air passage 60 and over heat exchanger assembly 32. In an embodiment, air blower 40 is electronically commutated to provide variable speed operation.

A temperature sensitive limit switch 72 is placed in the air passage 60 to ensure that there is adequate circulating airflow across the heat exchanger assembly 32. In one embodiment, the temperature sensitive limit switch 72 may be located anywhere within or on the HVAC unit 14. This switch may be a conventional bimetal actuated, normally closed switch which is designed to open at a predetermined temperature which will eventually occur in the air passage 60 if there is insufficient circulating air across the heat exchanger assembly 32 or some other malfunction that leads to excessive temperatures during periods in which hot gases are flowing through the heat exchanger 44. The predetermined temperature may be set so as to prevent damage to the HVAC unit 14 or the structure the HVAC unit 14 is located within as a result of excessive heat. For example, the limit switch 72 may be configured to open at a temperature greater than or equal to approximately 150 degrees Fahrenheit (approximately 65.6 degrees Celsius). It will be appreciated that the limit switch 72 may open at a temperature less than 150 degrees Fahrenheit (approximately 65.6 degrees Celsius). If the limit switch 72 opens, the control board 24 automatically shuts off the gas, brings on or continues to operate the blower 40 to cool off the heat exchanger 44, and removes the 24-volt power to the system controller 12. After a time delay, while the blower 40 cools the heat exchanger 44 and the limit switch 72, the limit switch 72 is reset and the system 10 commences another heating cycle.

Figure 3:
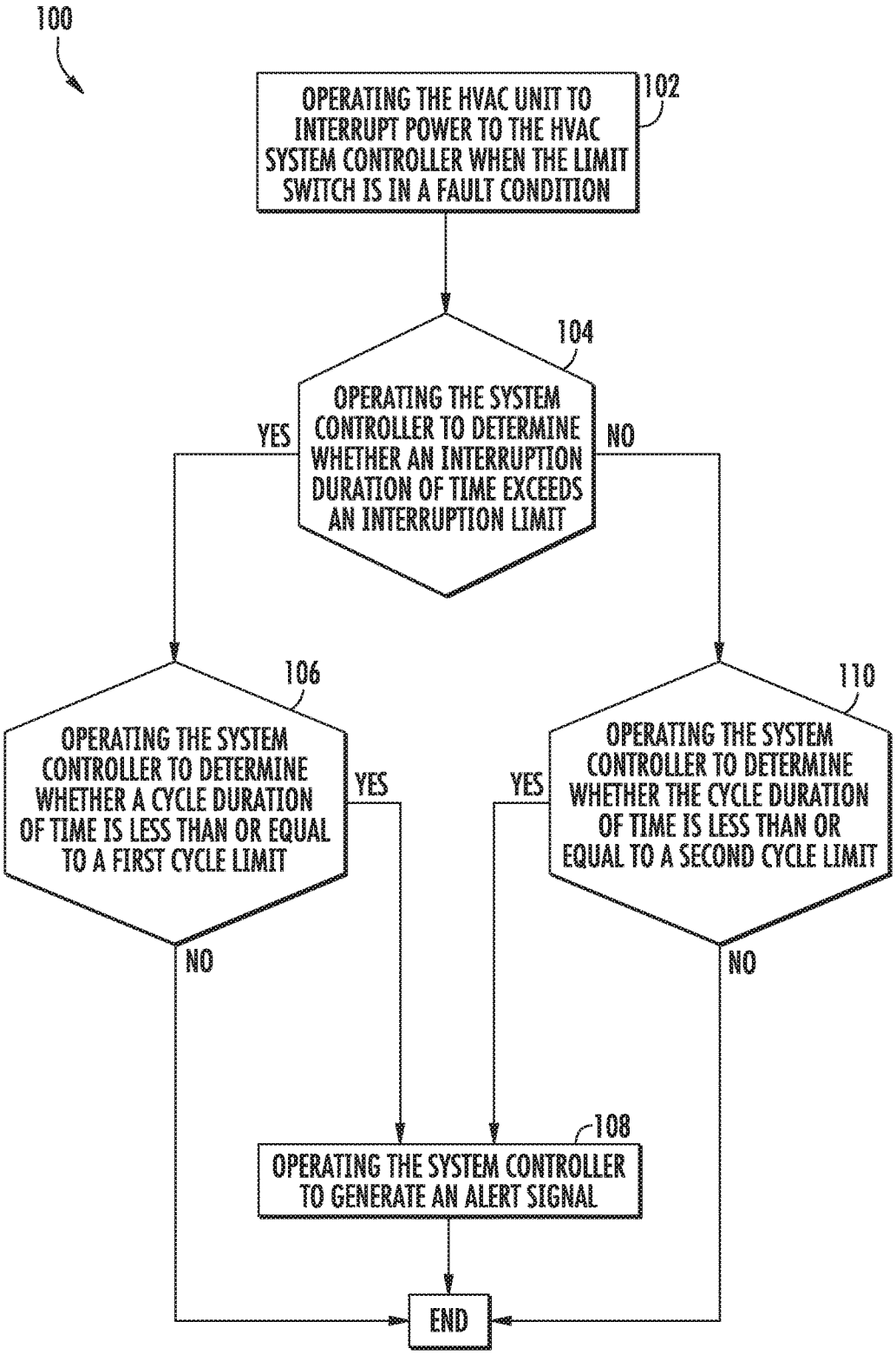
FIG. 3 illustrates a schematic flow diagram of a method for determining a limit fault in an HVAC unit according to one embodiment of the present disclosure.

FIG. 3 illustrates a method for determining a cause for a limit fault, the method generally indicated at 100. The method 100 includes step 102 of operating the HVAC unit 14 to interrupt power to the HVAC system controller 12 when the limit switch 72 is in a fault condition, step 104 of operating the system controller 12 to determine whether an interruption duration of time exceeds an interruption limit, step 106 of operating the system controller 12 to determine whether a cycle duration of time is less than or equal to a first cycle limit if the interruption duration of time does not exceeds the interruption limit, wherein the cycle duration of time is indicative of an amount of time between consecutive interruptions of power, and step 108 of operating the system controller 12 to generate an alert signal if the cycle duration of time is less than or equal to the first cycle limit.

In an embodiment, the method 100 further includes step 110 of operating the HVAC system controller 12 to determine whether the cycle duration of time is less than or equal to a second cycle limit if the interruption duration of time exceeds the interruption limit. In an embodiment, if the cycle duration of time is less than or equal to the second cycle limit, the method proceeds to step 108 of generating an alert signal.

In an embodiment, the interruption limit is approximately 3 minutes. It will be appreciated that the interruption limit may be adjustable within system controller 12, and, thereby, greater than or less than approximately 3 minutes.

In one embodiment, the first cycle limit is approximately 30 minutes. It will be appreciated that the first cycle limit may be adjustable within system controller 12, and may be greater than or less than approximately 30 minutes.

In one embodiment, the second cycle limit is approximately 5 hours. It will be appreciated that the second cycle limit may be adjustable within system controller 12, and may be greater than or less than approximately 5 hours. In one embodiment, the alert signal comprises at least one of a visual signal, an audio signal, and an electronic signal.

Figure 4:
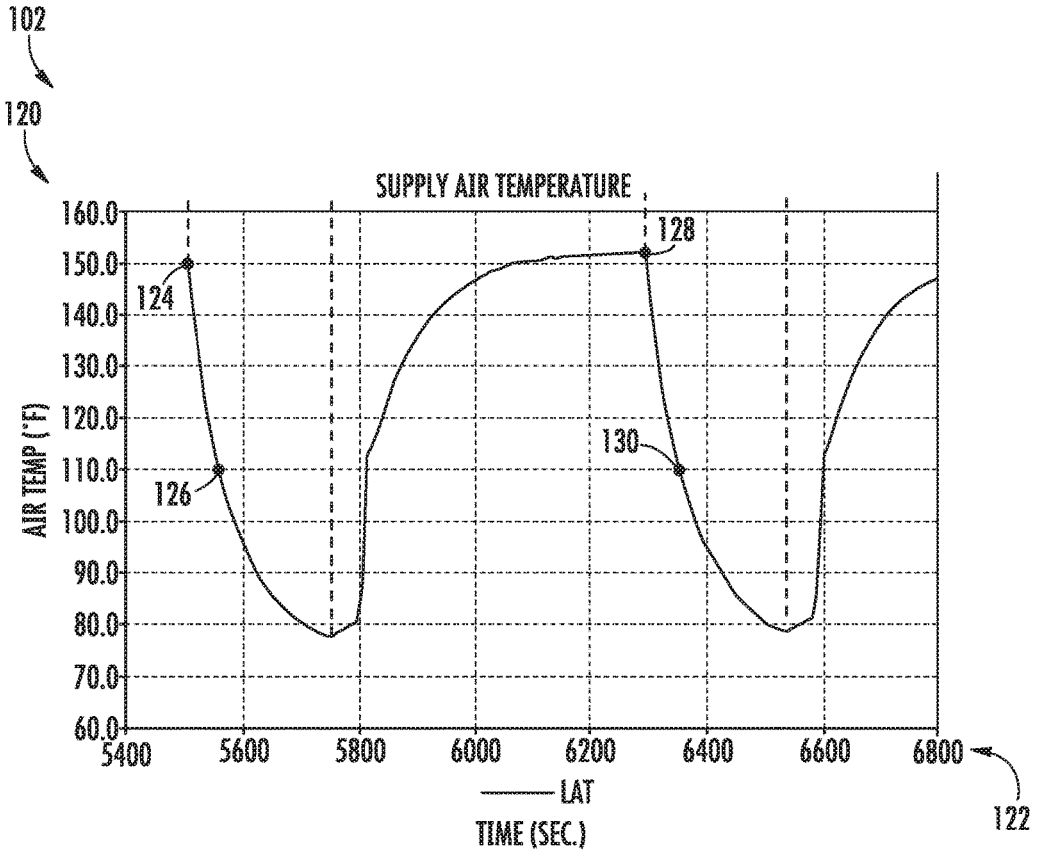
FIG. 4 illustrates a graph of supply air temperature versus time according to one embodiment of the present disclosure.

In one non-limiting example, with reference to FIG. 4 where a Y-axis 120 is measured air temperature within the within the passage 60, an X-axis 122 represents time. The HVAC unit 14 operates in a heating mode, and if the limit switch 72 opens during heating mode (at approximately 150 degrees Fahrenheit, represented by data point 124), the system controller 12 begins to monitor the duration of time the power has been interrupted (i.e. an interruption duration of time).

The control board 24 automatically shuts off the gas, and continues to operate or turns on blower 40 to cool the air within the passage 60. As the temperature within the passage 60 decreases, the limit switch 72 closes (at approximately 110 degrees Fahrenheit, represented by data point 126), and power is restored to the system controller 12. In the example of FIG. 4, power is restored to the system controller 12 within approximately 54 seconds. Since the interruption duration of time does not exceed the interruption limit (54 seconds<3 minutes), the system controller 12 then records this as a first occurrence of interrupted power. It should be appreciated that the limit switch 72 may open at temperatures greater than or less than 150 degrees Fahrenheit and close at temperatures greater than or less than 110 degrees Fahrenheit.

Once the limit switch closes, HVAC unit 14 will again operate in a heating mode after a brief time delay. As shown, in the example of FIG. 4, the air temperature within the passage 60 reaches approximately 150 degrees Fahrenheit (represented by data point 128) and the limit switch 72 opens for a second time. Again, control board 24 automatically shuts off the gas, and continues to operate or turns on the blower 40 to cool the air within the passage 60. As the temperature within the passage 60 decreases, the limit switch 72 closes (at approximately 110 degrees Fahrenheit, represented by data point 130), and power is restored to the system controller 12. In this instance, power is restored to the system controller 12 within approximately 56 seconds. Since the interruption duration of time does not exceed the interruption limit (54 seconds<3 minutes), the system controller 12 then records this as a second occurrence of interrupted power. The system controller 12 then determines that consecutive interruptions of power have occurred, and determines whether a cycle duration of time is less than or equal to a first cycle limit.

In the embodiment shown in FIG. 4, the first interruption of power occurs at an approximate time of 5500 seconds (data point 124), and the second interruption of power occurs at an approximate time of 6300 seconds (data point 126). As such, the system controller 12 examines the time difference between the first interruption of power and the second interruption of power (i.e. the cycle duration of time of approximately 800 seconds or 13 minutes 20 seconds).

Since the cycle duration of time (13 minutes 20 seconds) is less than or equal to approximately 30 minutes, and the interruption duration of time for consecutive power interruptions is less than the interruption limit, the system controller 12, in accordance with the present method, recognizes this power outage pattern as indicative of a limit switch fault and generates a signal on the display 20, or to other devices, to alert the user or service personnel of a limit switch fault.

Additionally, in one embodiment, the system controller 12 may determine whether the limit switch fault is caused by an improperly operating blower 40. Similar to the operation as described above, the HVAC unit 14 operates in a heating mode, and if the limit switch 72 opens, the system controller 12 begins to monitor the duration of time the power has been interrupted (i.e. an interruption duration of time).

The control board 24 automatically shuts off the gas, and continues to operate or turns on blower 40 to cool the air within the passage 60. As the temperature within the passage 60 decreases, the limit switch 72 closes and power is restored to the system controller 12. If power is restored to the system controller 12 in a time greater than the interruption limit, the system controller 12 then records this as a first occurrence of interrupted power.

Once the limit switch closes, HVAC unit 14 will again operate in a heating mode after a brief time delay. Again, if the limit switch 72 opens, control board 24 automatically shuts off the gas, and continues to operate or turns on the blower 40 to cool the air within the passage 60. If power is restored to the system controller 12 in a time greater than the interruption limit, the system controller 12 then records this as a second occurrence of interrupted power. The system controller 12 then determines that consecutive interruptions of power have occurred, and determines whether a cycle duration of time is less than or equal to a second cycle limit.

If the cycle duration of time is less than or equal to the second cycle limit, which in one embodiment may be approximately 5 hours, and the interruption duration of time for consecutive power interruptions is greater than the interruption limit, the system controller 12 will generate a signal on the display 20, or to other devices, to alert the user or service personnel of a limit switch fault due to the blower 40 being inoperable or faulty.

It will therefore be appreciated that the present embodiments includes a system and method determining a limit switch 72 fault based on the cycling of power to the system controller 12. It will further be appreciated that the present embodiments include a system and method determining whether a blower 40 is operating based upon a limit switch 72 and the cycling of power to the system controller 12.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. An HVAC system comprising:

an HVAC unit configured to interrupt power when a temperature sensed by a temperature sensitive limit switch exceeds a predetermined temperature and to restore power based on a temperature sensed by the temperature sensitive limit switch; and a system controller in electrical communication with the HVAC unit, the system controller is configured to determine a temperature limit switch fault based upon an interruption duration of time and a cycle duration of time, wherein the cycle duration of time is indicative of an amount of time between consecutive interruptions of power;

wherein the system controller is further configured to generate an alert signal if it is determined that the interruption duration of time of consecutive interruptions of power does not exceed an interruption limit and the cycle duration of time is less than or equal to a first cycle limit;

wherein the system controller is further configured to generate the alert signal if it is determined that the interruption duration of time exceeds the interruption limit and the cycle duration of time is less than or equal to a second cycle limit;

wherein the first cycle limit is less than the second cycle limit.

2. The HVAC system of claim 1, wherein the alert signal comprises at least one of a visual signal, an audio signal, and an electronic signal.

3. The HVAC system of claim 1, wherein the system controller is in wireless electrical communication with the HVAC unit.

4. The HVAC system of claim 1, wherein the system controller comprises a thermostat.

5. A method of determining a cause for a limit fault in an HVAC unit including a limit switch, the HVAC unit in electrical communication with an HVAC system controller, the method comprising:

(a) operating the HVAC unit to interrupt power to the HVAC system controller when the limit switch is in a fault condition;

(b) operating the HVAC unit to restore power to the HVAC system controller based on a temperature;

(c) operating the system controller to determine whether an interruption duration of time exceeds an interruption limit;

(d) operating the system controller to determine whether a cycle duration of time is less than or equal to a first cycle limit if the interruption duration of time does not exceed the interruption limit, wherein the cycle duration of time is indicative of an amount of time between consecutive interruptions of power; and (e) operating the system controller to generate an alert signal if the cycle duration of time is less than or equal to the first cycle limit;

wherein step (d) further comprises operating the system controller to determine whether the cycle duration of time is less than or equal to a second cycle limit if the interruption duration of time between consecutive interruptions of power exceeds the interruption limit;

wherein step (e) further comprises generating the alert signal if the cycle duration of time is less than or equal to the second cycle limit and the interruption duration of time between consecutive interruptions of power exceeds the interruption limit;

wherein the first cycle limit is less than the second cycle limit.

6. The method of claim 5, wherein the interruption limit is approximately 3 minutes.

7. The method of claim 5, wherein the first cycle limit is approximately 30 minutes.

8. The method of claim 5, the second cycle limit is approximately 5 hours.

9. The method of claim 5, wherein the alert signal comprises at least one of a visual signal, an audio signal, and an electronic signal.

* * * * *